US012029377B2

(12) United States Patent
Howard

(10) Patent No.: US 12,029,377 B2
(45) Date of Patent: Jul. 9, 2024

(54) VACUUM BAG

(71) Applicant: ZHF Group, LLC, Chagrin Falls, OH (US)

(72) Inventor: Mark W. Howard, Bentleyville, OH (US)

(73) Assignee: ZHF GROUP, LLC, Chagrin Falls, OH (US)

( * ) Notice: Subject to any disclaimer, the term of this patent is extended or adjusted under 35 U.S.C. 154(b) by 211 days.

(21) Appl. No.: 17/370,076

(22) Filed: Jul. 8, 2021

(65) Prior Publication Data

US 2023/0012256 A1 Jan. 12, 2023

(51) Int. Cl.
*A47L 9/14* (2006.01)
*D04H 1/559* (2012.01)

(52) U.S. Cl.
CPC ..... *A47L 9/14* (2013.01); *D04H 1/559* (2013.01)

(58) Field of Classification Search
CPC ... A47L 9/14; B01D 39/1607; B01D 39/1623; B01D 39/18; B32B 29/02; B32B 5/26; D04H 1/4374; D04H 1/559; D04H 1/56; D04H 1/593; Y10S 55/02
See application file for complete search history.

(56) References Cited

U.S. PATENT DOCUMENTS 3,498,031 A * 3/1970 Fesco ..... A47L 9/14 55/378
3,827,396 A * 8/1974 Terzuoli ..... A47L 9/14 156/203
3,859,064 A * 1/1975 Cordell ..... A47L 9/14 55/382
4,844,914 A * 7/1989 Bonne ..... B65B 29/028 206/0.5
5,080,702 A 1/1992 Bosses
5,419,953 A * 5/1995 Chapman ..... B32B 5/06 442/388
5,667,562 A 9/1997 Midkiff
5,898,981 A * 5/1999 Legare ..... B32B 5/26 28/107
6,045,595 A 4/2000 Freudenberg
6,156,086 A * 12/2000 Zhang ..... B01D 39/1623 428/36.1
6,171,369 B1 * 1/2001 Schultink ..... B32B 29/02 15/352
6,183,536 B1 2/2001 Schultink et al.
6,193,773 B1 * 2/2001 Schlor ..... B01D 39/1623 55/486

(Continued)

FOREIGN PATENT DOCUMENTS

EP 0822775 B1 1/1999
ES 2361746 T3 6/2011

(Continued)

*Primary Examiner* — Dung H Bui
(74) *Attorney, Agent, or Firm* — Amin, Turocy & Watson, LLP

(57) ABSTRACT

Techniques regarding vacuum bags are provided. For example, one or more embodiments described herein can comprise a vacuum bag comprising a spunbond meltblown spunbond (SMS) liner layer adhered to a carrier layer of non-woven material. The vacuum bag can also comprise a seam comprising an adhesive layer bonding a first end of the carrier layer directly to a second end of the carrier layer.

20 Claims, 13 Drawing Sheets

(56) References Cited

U.S. PATENT DOCUMENTS 6,428,610 B1 * 8/2002 Tsai ..... B01D 46/0028 96/100
6,524,359 B1 * 2/2003 Kluge ..... B01D 46/023 156/227
6,669,761 B2 12/2003 Schultheiss et al.
6,966,939 B2 11/2005 Rammig et al.
8,070,858 B2 * 12/2011 Schultink ..... D04H 1/559 55/486
8,070,862 B2 * 12/2011 Woo ..... B01D 46/02 55/486
8,236,078 B2 * 8/2012 Rosemeier ..... A47L 9/14 55/486
8,479,356 B2 7/2013 Sauer et al.
9,554,681 B2 1/2017 Schultink et al.
10,300,419 B2 * 5/2019 Scope ..... B01D 39/08
10,357,730 B2 * 7/2019 Gao ..... B01D 46/521
11,602,252 B2 * 3/2023 Schultink ..... A47L 9/14
2001/0047721 A1 12/2001 Scanlon
2003/0000389 A1 * 1/2003 Schultheiss ..... B01D 46/02 55/486
2005/0065489 A1 * 3/2005 Driskell ..... A61F 13/42 604/361
2006/0144024 A1 * 7/2006 Sauer ..... B01D 39/18 55/382
2008/0115671 A1 5/2008 Sauer et al.
2008/0220681 A1 * 9/2008 Marin ..... D04H 1/724 428/401
2010/0229512 A1 * 9/2010 Howard ..... B01D 46/02 55/378
2012/0093443 A1 * 4/2012 Klein ..... B65D 31/00 383/211
2014/0318280 A1 * 10/2014 Mihaylov ..... G01N 1/24 73/864.51
2015/0117800 A1 * 4/2015 Petersen ..... B65D 33/04 383/106
2016/0158999 A1 * 6/2016 Cloud ..... B29C 66/73921 156/60
2020/0094178 A1 * 3/2020 Nakano ..... B01D 29/27

FOREIGN PATENT DOCUMENTS

JP H01107821 A 4/1989
WO 2005/060807 A1 7/2005

* cited by examiner

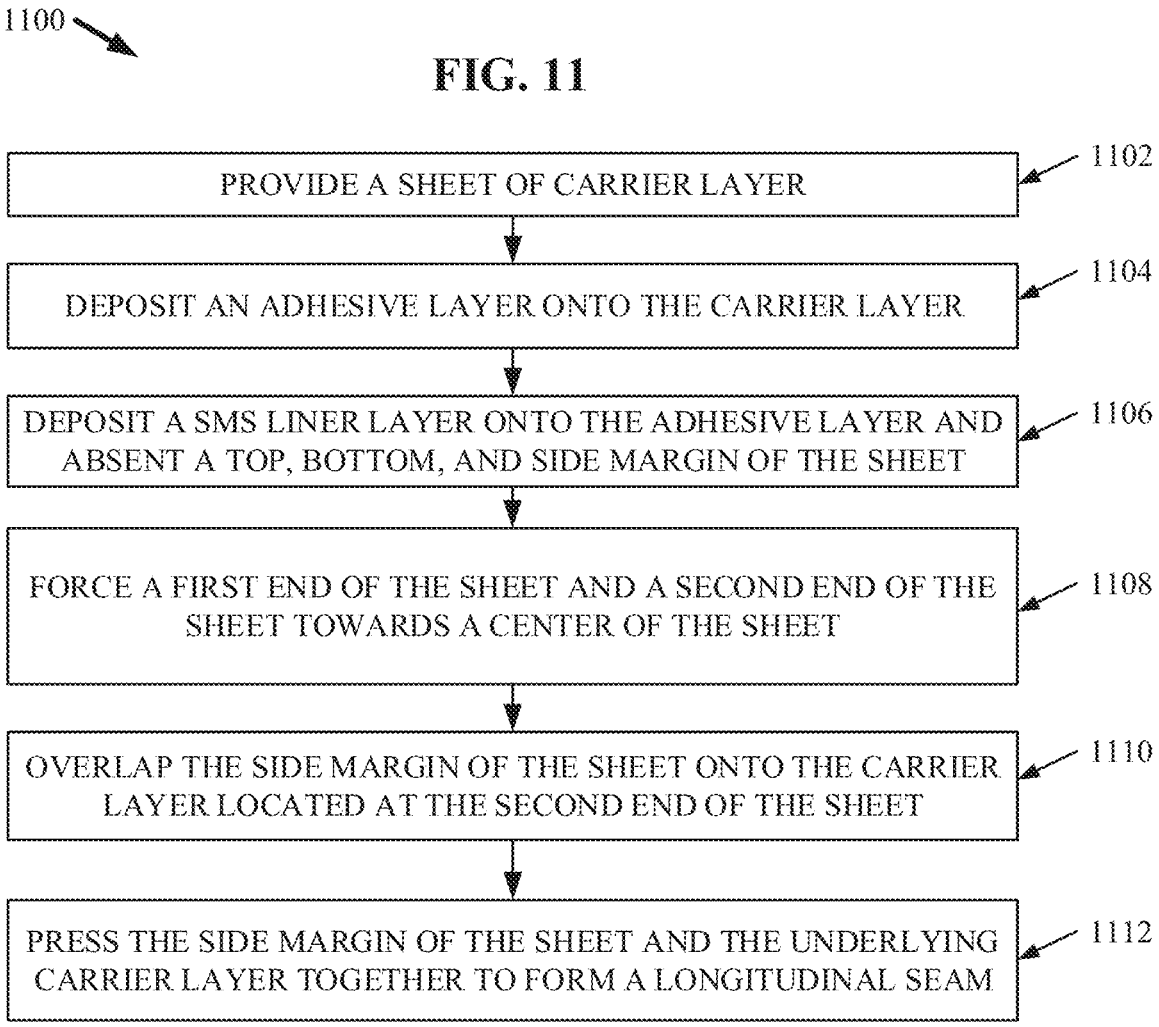
1100
FIG. 11
PROVIDE A SHEET OF CARRIER LAYER
1102
DEPOSIT AN ADHESIVE LAYER ONTO THE CARRIER LAYER
1104
DEPOSIT A SMS LINER LAYER ONTO THE ADHESIVE LAYER AND ABSENT A TOP, BOTTOM, AND SIDE MARGIN OF THE SHEET
1106
FORCE A FIRST END OF THE SHEET AND A SECOND END OF THE SHEET TOWARDS A CENTER OF THE SHEET
1108
OVERLAP THE SIDE MARGIN OF THE SHEET ONTO THE CARRIER LAYER LOCATED AT THE SECOND END OF THE SHEET
1110
PRESS THE SIDE MARGIN OF THE SHEET AND THE UNDERLYING CARRIER LAYER TOGETHER TO FORM A LONGITUDINAL SEAM
1112

VACUUM BAG

BACKGROUND

The subject disclosure relates to a vacuum bag, and more specifically, a vacuum bag with a non-woven material carrier layer and a spunbond meltblown spunbod ("SMS") liner and one or more seams formed via one or more adhesive layers.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later. In one or more embodiments described herein, devices, apparatuses, and/or methods regarding vacuum bags with SMS liners and adhesive formed seams are described.

According to an embodiment, a vacuum bag is provided. The vacuum bag can comprise a spunbond meltblown spunbond (SMS) liner layer adhered to a carrier layer of non-woven material. The vacuum bag can also comprise a seam comprising an adhesive layer bonding a first end of the carrier layer directly to a second end of the carrier layer.

According to another embodiment, a vacuum bag is provided. The vacuum bag can comprise a spunbond meltblown spunbond (SMS) liner layer adhered to a paper layer. The SMS liner layer can comprise a single layer of meltblown polymer integrated between fibers of spunbond polymer. The vacuum bag comprises a seam comprising a first end of the paper layer directly bonded to a second end of the paper layer via an adhesive layer.

According to an embodiment, a method for manufacturing a vacuum bag is provided. The method can comprise providing a sheet comprising a spunbond meltblown spunbond (SMS) liner layer, an adhesive layer, and a carrier layer. The sheet can have a side margin that can comprise the carrier layer and the adhesive layer absent the SMS liner layer. The method can also comprise forcing a first end of the sheet and a second end of the sheet towards a center of the sheet. The side margin can be located at the first end of the sheet. Further, the method can comprise forming a seam by overlapping the side margin onto the carrier layer located at the second end of the sheet.

BRIEF DESCRIPTION OF THE DRAWINGS

FIG. 11 illustrates a flow diagram of an example, non-limiting method that can facilitate forming one or more longitudinal seams of a vacuum bag in accordance with one or more embodiments described herein.

DETAILED DESCRIPTION

Figure 1:
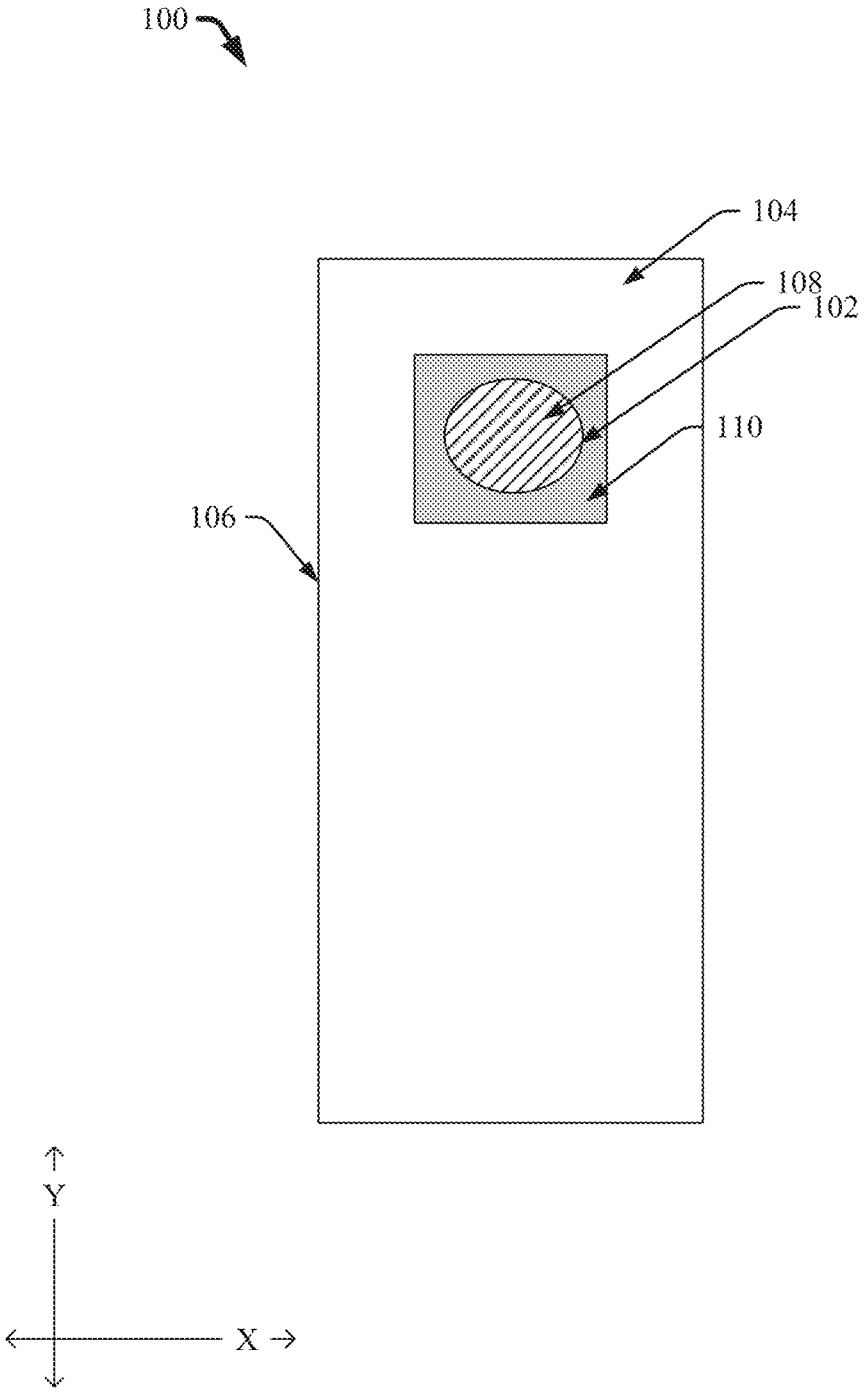
FIG. 1 illustrates a diagram of an example, non-limiting front side of one or more vacuum bags with one or more SMS liners and/or seams formed via one or more adhesive layers in accordance with one or more embodiments described herein.

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details. Additionally, features depicted in the drawings with like shading, cross-hatching, and/or coloring can comprise shared compositions and/or materials.

Vacuum bags can be used to facilitate operation of various types of vacuum cleaners. For example, vacuum bags can be installed within the inner circumference of a collection container of the vacuum cleaner. During operation of the vacuum cleaner, the vacuum bags can collect debris, dirt, dust, and/or the like. Depending on the application of the vacuum cleaners, the vacuum bags may be expected to collect large amounts (e.g., hundreds of pounds) of debris. Additionally, some vacuum cleaners can utilize an inlet that protrudes into the vacuum bags to establish fluid communication between the cleaner and bag; thereby inhibiting removal of the bag without damaging the walls of the bag.

Various embodiments described herein regard vacuum bags that can exhibit enhanced strength and/or durability characteristics (e.g., as compared to existing vacuum bags) to accommodate a variety of vacuum cleaner applications. One or more embodiments described herein can include a vacuum bag with one or more SMS liners adjacent to one or more carrier layers comprised of a non-woven material (e.g., one or more paper layers). In various embodiments, the one or more SMS liners can be formed from an integral SMS material, where the meltblown material is integrated within, and/or between, the fibers of the spunbond material (e.g., rather than positioned as a respective layer between layers of spunbond material). The one or more SMS liners can provide the vacuum bag with strength and/or durability advantages. For example, a benchmark strength test for vacuum bags can include filling a hanging vacuum bag with 150 pounds of weight. The vacuum bag can pass the strength test by hanging for 30 minutes without breaking. Various embodiments described herein can regard vacuum bags that can hang with 275 pounds of weight for at least 8 hours without breaking. Further, the one or more carrier layers can provide filtration advantages. Moreover, the one or more SMS liners can be positioned on the one or more carrier layers such that seams of the one or more vacuum bags can be formed via one or more adhesive layers. Thereby, the one or more vacuum bags can be manufactured without the need for sonic welding techniques that are typically employed with SMS materials.

FIG. 1 illustrates a diagram of an example, non-limiting vacuum bag 100 with one or more inlets 102 positioned on a front side 104 in accordance with one or more embodiments described herein. Repetitive description of like elements employed in other embodiments described herein is omitted for the sake of brevity. In various embodiments, the one or more inlets 102 can enable one or more vacuum cleaners to establish a fluid communication with the interior of the one or more vacuum bags 100. While FIG. 1 depicts the one or more inlets 102 with a circular shape, the architecture of the one or more inlets 102 is not so limited. For example, inlets 102 having a polygonal shape are also envisaged.

Further, the vacuum bag 100 can comprise one or more carrier layers 106 and/or one or more SMS liner layers 108. In various embodiments, the one or more inlets 102 can be one or more holes formed in a portion of the one or more carrier layers 106 and/or SMS liner layers 108 comprising the front side 104 of the vacuum bag 100. For instance, FIG. 1 depicts the one or more inlets 102 as a hole formed in a portion of the one or more carrier layers 106 and/or SMS liner layers 108, whereupon the portion of the SMS liner layers 108 positioned within the interior of the vacuum bag 100 is visible. Additionally, the one or more inlets 102 can be at least partially surrounded by one or more collars 110. For instance, the one or more collars 110 can comprise a rigid material (e.g., cardboard, plastic, ceramic, metal, resign, a combination thereof, and/or the like) to provide structural support to portions of the one or more carrier layers 106 and/or SMS liner layers 108 surrounding the one or more inlets 102.

FIG. 1 depicts the vacuum bag 100 in a collapsed state. During operation, an airflow entering the vacuum bag 100 via the one or more inlets 102 can expand the vacuum bag 100 to a greater volume. The volume capacity of the vacuum bag 100 can vary depending on application. For instance, the vacuum bag 100 can have a volume capacity of up to, for example, 25 gallons. While FIG. 1 depicts the vacuum bag 100 with a rectangular shape, the architecture of the vacuum bag 100 is not so limited. For example, additional shapes (e.g. circular or polygonal) can be employed based on one or more dimensions of the types of vacuum cleaner that will employ the vacuum bag 100. As shown in FIG. 1, the "Y" axis can depict a longitudinal direction of the vacuum bag 100, and the "X" axis can depict a lateral direction of the vacuum bag 100. In various embodiments, the vacuum bag 100 can have a width along the longitudinal direction ranging from, for example, greater than or equal to 2 inches and less than or equal to 72 inches (e.g., 58.5 inches). Additionally, the vacuum bag 100 can have a length along the lateral direction ranging from, for example, greater than or equal to 2 inches and less than or equal to 72 inches (e.g., 46 inches).

Figure 2:
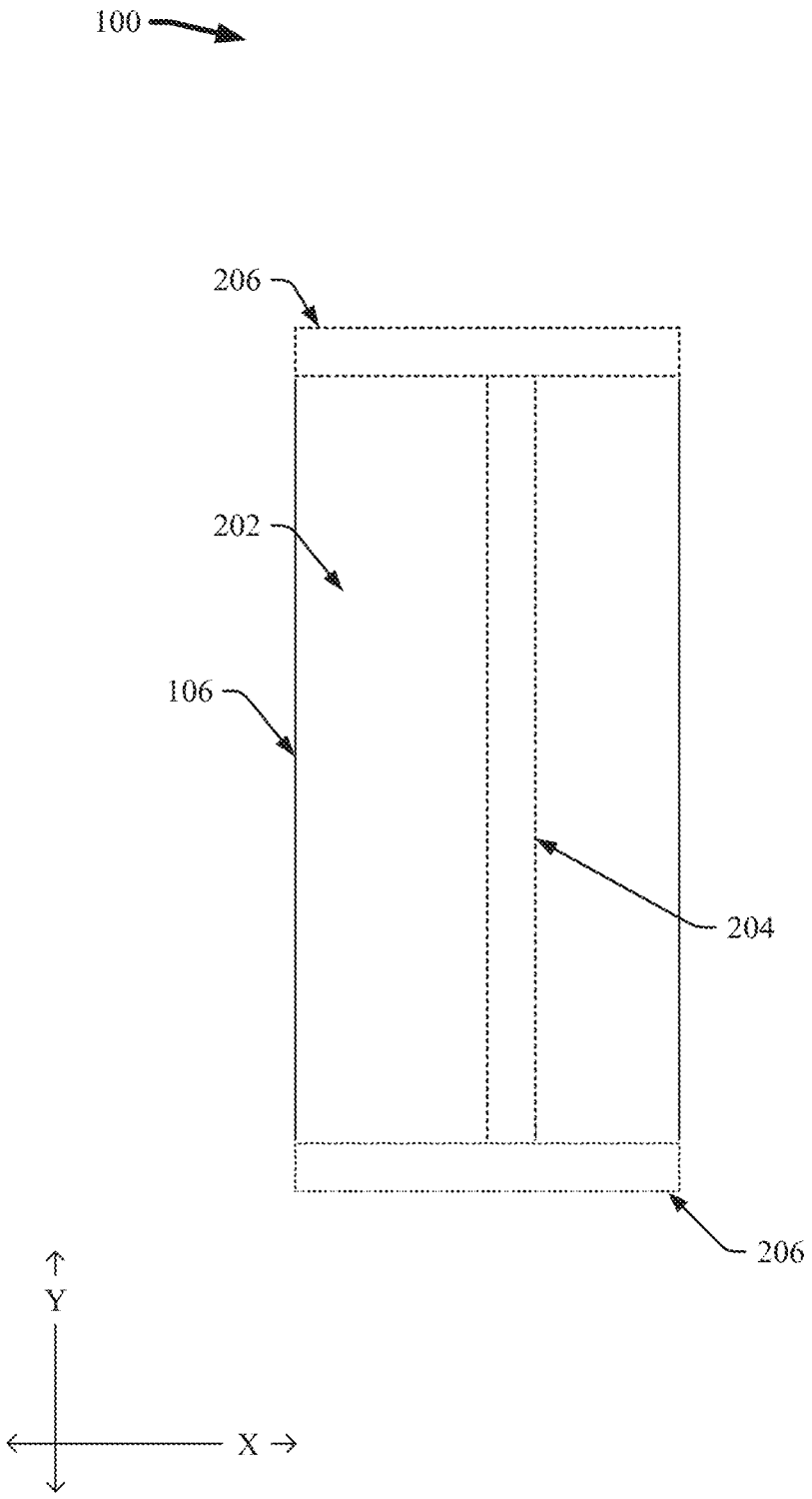
FIG. 2 illustrates a diagram of an example, non-limiting back side of one or more vacuum bags with one or more SMS liners and/or seams formed via one or more adhesive layers in accordance with one or more embodiments described herein.

FIG. 2 illustrates a diagram of an example, non-limiting vacuum bag 100 with one or more seams positioned on a back side 202 in accordance with one or more embodiments described herein. Repetitive description of like elements employed in other embodiments described herein is omitted for the sake of brevity. In various embodiments, the back side 202 of the vacuum bag 100 can comprise one or more longitudinal seams 204 and/or lateral seams 206. While FIG. 2 depicts the one or more longitudinal seams 204 and/or lateral seams 206 on the back side 202 of the vacuum bag 100, the architecture of the vacuum bag 100 is not so limited. For example, embodiments in which the front side 104 of vacuum bag 100 comprises the one or more longitudinal seams 204 and/or lateral seams 206 are also envisaged. For example, the one or more longitudinal seams 204 can extend along the longitudinal direction (e.g., "Y" axis shown in FIG. 2) of the vacuum bag 100 from a first end (e.g., a top end) to a second end (e.g., a bottom end). Also, the one or more lateral seams 206 can extend along the lateral direction (e.g., "X" axis shown in FIG. 2) of the vacuum bag 100 from third end (e.g., a left end) to a fourth end (e.g., a right end).

As show in FIG. 2, the one or more position of the one or more longitudinal seams 204 and/or lateral seams 206 are delineated with dotted lines. In various embodiments, the one or more longitudinal seams 204 and/or lateral seams 206 can be formed by folding and gluing portions of the carrier layer 106. Further, portions of the one or more longitudinal seams 204 and/or lateral seams 206 can overlap each other. The one or more longitudinal seams 204 can have a width (e.g., along the "X" axis shown in FIG. 2) ranging from, for example, greater than or equal to 2 centimeters and less than or equal to 1 foot. Additionally, the one or more lateral seams 206 can have width (e.g., long the "Y" axis shown in FIG. 2) ranging from, for example, greater than or equal to 2 centimeters and less than or equal to 1 foot. FIG. 2 depicts the vacuum bag 100 comprising a single longitudinal seam 204; however, embodiments in which the vacuum bag 100 comprises multiple longitudinal seams 204 are also envisaged. In various embodiments, the vacuum bag 100 can comprise a lateral seam 206 at the top and bottom ends of the vacuum bag 100 (e.g., as shown in FIG. 2).

Figure 3:
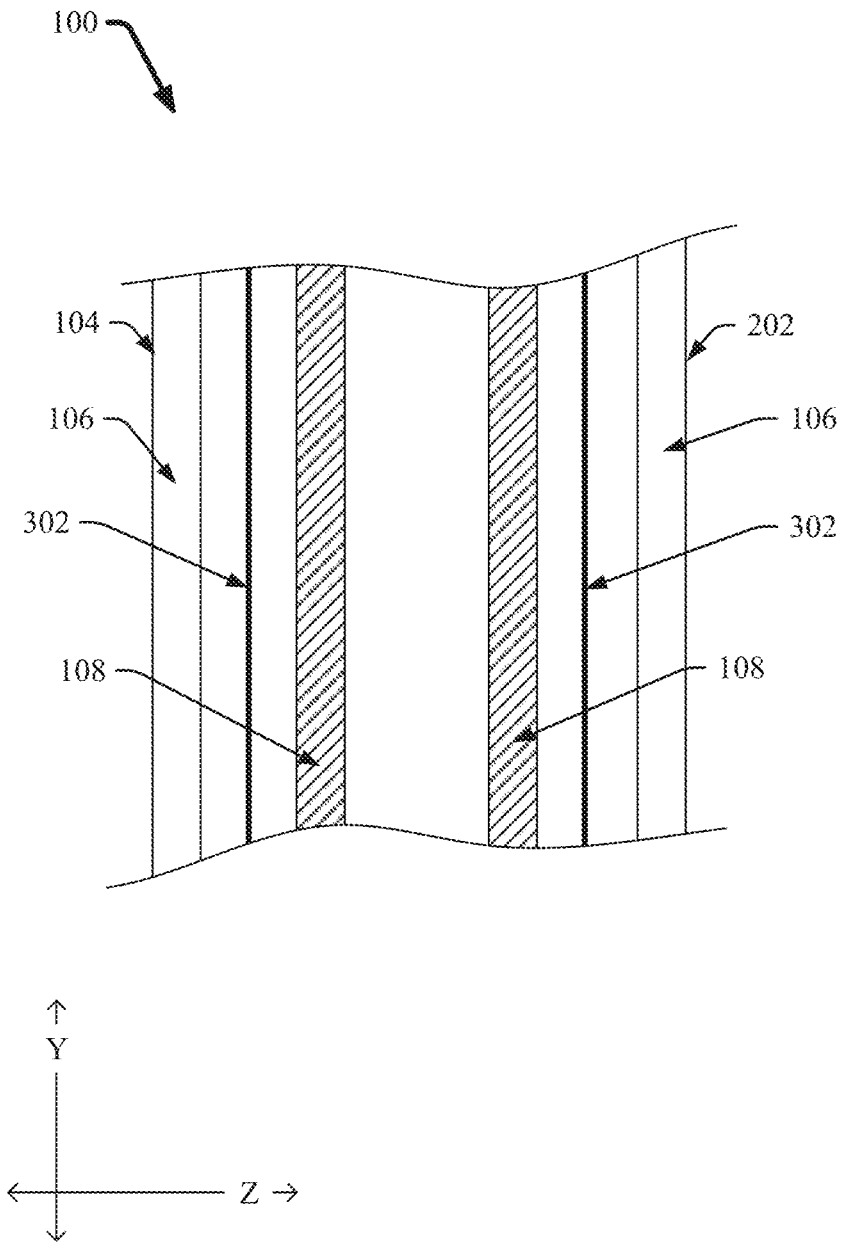
FIG. 3 illustrates a diagram of an example, non-limiting exploded cross-section of one or more walls of a vacuum bag with one or more SMS liners and/or seams formed via one or more adhesive layers in accordance with one or more embodiments described herein.

FIG. 3 illustrates a diagram of an example, non-limiting exploded cross-sectional view of the vacuum bag 100 in accordance with one or more embodiments described herein. Repetitive description of like elements employed in other embodiments described herein is omitted for the sake of brevity. As shown in FIG. 3, the "Z" axis can depict a thickness direction of the vacuum bag 100. During operation, airflow between the front side 104 and the back side 202 of the vacuum bag 100 can cause the vacuum bag 100 to expand along the thickness direction.

In various embodiments, the walls of the vacuum bag 100 (e.g. the front side 104, the back side 202 and/or one or more intermediary sides connecting the front side 104 and/or the back side 202) can comprise the carrier layer 106, the one or more SMS liner layers 108, and/or one or more adhesive layers 302. In various embodiments, the one or more carrier layers 106 can be comprised of one or more non-woven materials. Example materials comprised in the one or more carrier layers 106 can include, but are not limited to: paper, wood paper, hemp paper, filter paper, a non-woven material comprising cellulose fibers, a combination thereof, and/or the like. For example, the one or more carrier layers 106 can comprise paper having a weight ranging from, for example, greater than or equal to 25 grams per square meter ($g/m^2$) and less than or equal to 60 $g/m^2$ (e.g., less than 50 $g/m^2$).

In various embodiments, the one or more SMS liner layers 108 can comprise a SMS material having spunbond and meltblown polymer (e.g., polypropylene). For instance, the SMS material can have a structure in which the spunbond polymer and the meltblown polymer are integrated together to form a single layer of SMS material. Rather than a composition of a respective meltblown layer between respective spunbond layers, the SMS material comprised within the one or more SMS liner layers 108 can include meltblown polymer positioned between spunbond polymer fibers within the same layer of SMS material. In other words, the one or more SMS liner layers 108 can comprise a single layer of meltblown polymer integrated between fibers of spunbond polymer. In various embodiments, the one or more SMS liner layers 108 can have a weight ranging from, for example, greater than or equal to 20 $g/m^2$ and less than 40 $g/m^2$ (e.g., 30-40 $g/m^2$).

In various embodiments, the one or more adhesive layers 302 can be positioned between the one or more carrier layers 106 and SMS liner layers 108. For example, the one or more adhesive layers 302 can adhere the one or more SMS liner layers 108 to the one or more carrier layers 106. Example types of adhesives that can comprised in the one or more adhesive layers 302 can include, but are not limited to: a hotmelt adhesive, a cold glue adhesive, a dry-bond adhesive, a thermoplastic polymer adhesive, a combination thereof, and/or the like.

Figure 4:
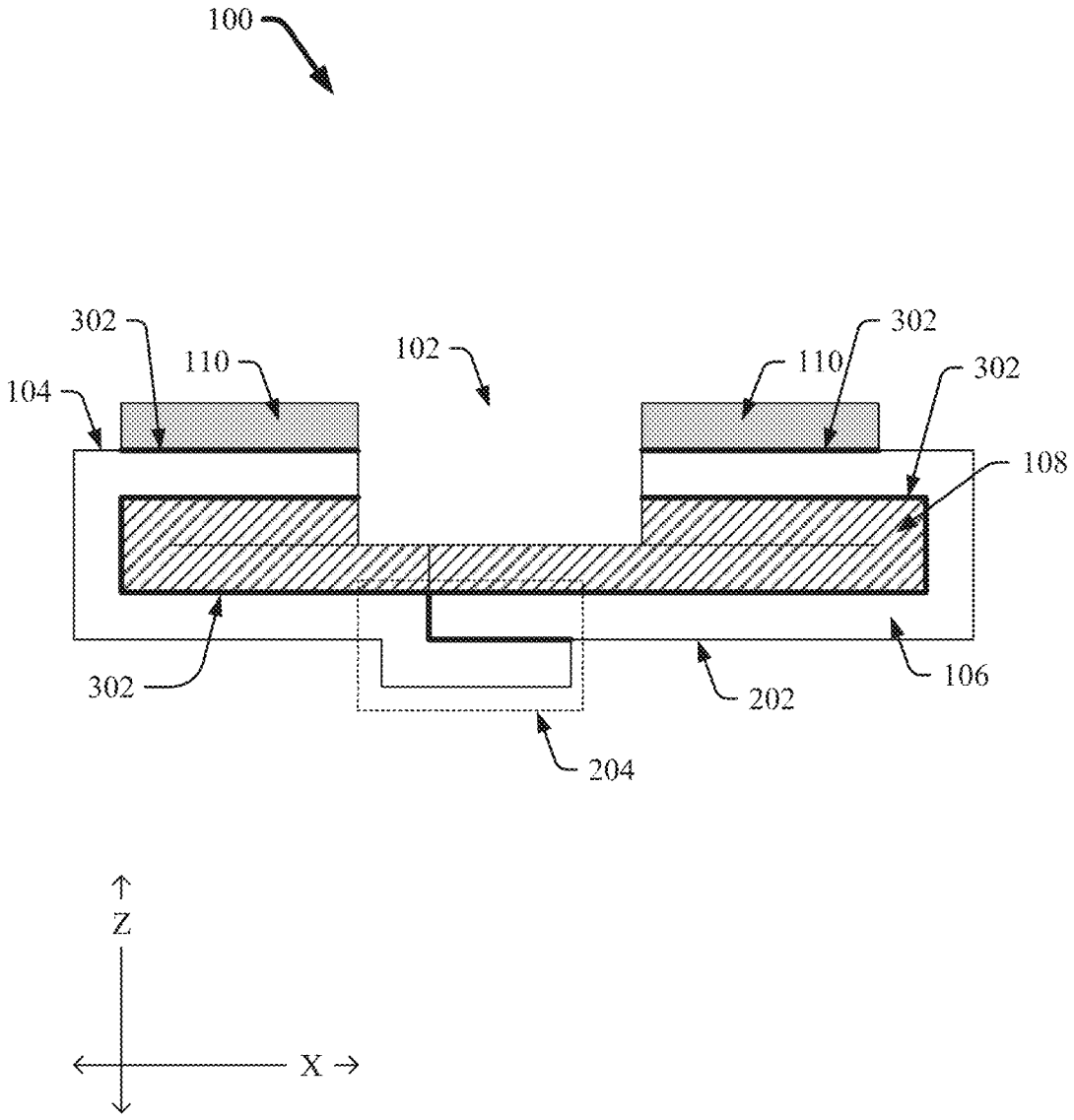
FIG. 4 illustrates a diagram of an example, non-limiting cross-section of a longitudinal seam of one or more vacuum bags with one or more SMS liners in accordance with one or more embodiments described herein.

FIG. 4 illustrates a diagram of an example, non-limiting cross-sectional view of the vacuum bag 100 along a plane that includes the one or more inlets 102 in accordance with one or more embodiments described herein. Repetitive description of like elements employed in other embodiments described herein is omitted for the sake of brevity. As shown in FIG. 4, the one or more inlets 102 can extend through one or more portions of the one or more carrier layers 106 and/or SMS liner layers 108 that define the front side 104 of the vacuum bag 100. Further, portions of the one or more carrier layers 106 can overlap each other (e.g., at the back side 202) to form the one or more longitudinal seams 204.

In various embodiments, the one or more adhesive layers 302 can be employed to adhere the one or more collars 110 to the one or more carrier layers 106 (e.g., on the front side 104 of the vacuum bag 100) adjacent to the one or more inlets 102. For example, the one or more adhesive layers 302 can be positioned between the one or more collar 110 and the one or more carrier layers 106 (e.g., as shown in FIG. 4). Thus, in various embodiments, the one or more adhesive layers 302 can adhere: the one or more collars 110 to the one or more carrier layers 106, the one or more SMS liner layers 108 to the one or more carrier layers 106, and/or respective portions of the one or more carrier layers 106 to each other to form the one or more longitudinal seams 204.

In one or more embodiments, the vacuum bag 100 can be manufacturing from a sheet of the one or more carrier layers 106 with the one or more SMS liner layers 108 adhered thereto. To form the structure of the vacuum bag 100, the sheet can be wrapped to a defined shape, where a portion of the carrier layer 106 located at one end can overlap another portion of the carrier layer 106 located at the opposite end. For example, one or more adhesive layers 302 can be positioned on the carrier layer 106 without being covered by the one or more SMS liner layers 108, thereby facilitating adhesion between the portions of carrier layer 106 overlapping each other at the longitudinal seam 204. As such, the one or more longitudinal seams 204 can comprise a first portion of carrier layer 106 overlapping a second portion of carrier layer 106, with one or more adhesive layers 302 adhering the first and second portions together (e.g., as shown in FIG. 4). At least because the one or more SMS liner layers 108 are not located between the overlapping portions of carrier layer 106, the longitudinal seam 204 can be formed via adhesion established by the one or more adhesive layers 302 directly in contact with the overlapping portions of carrier layer 106.

Figure 5:
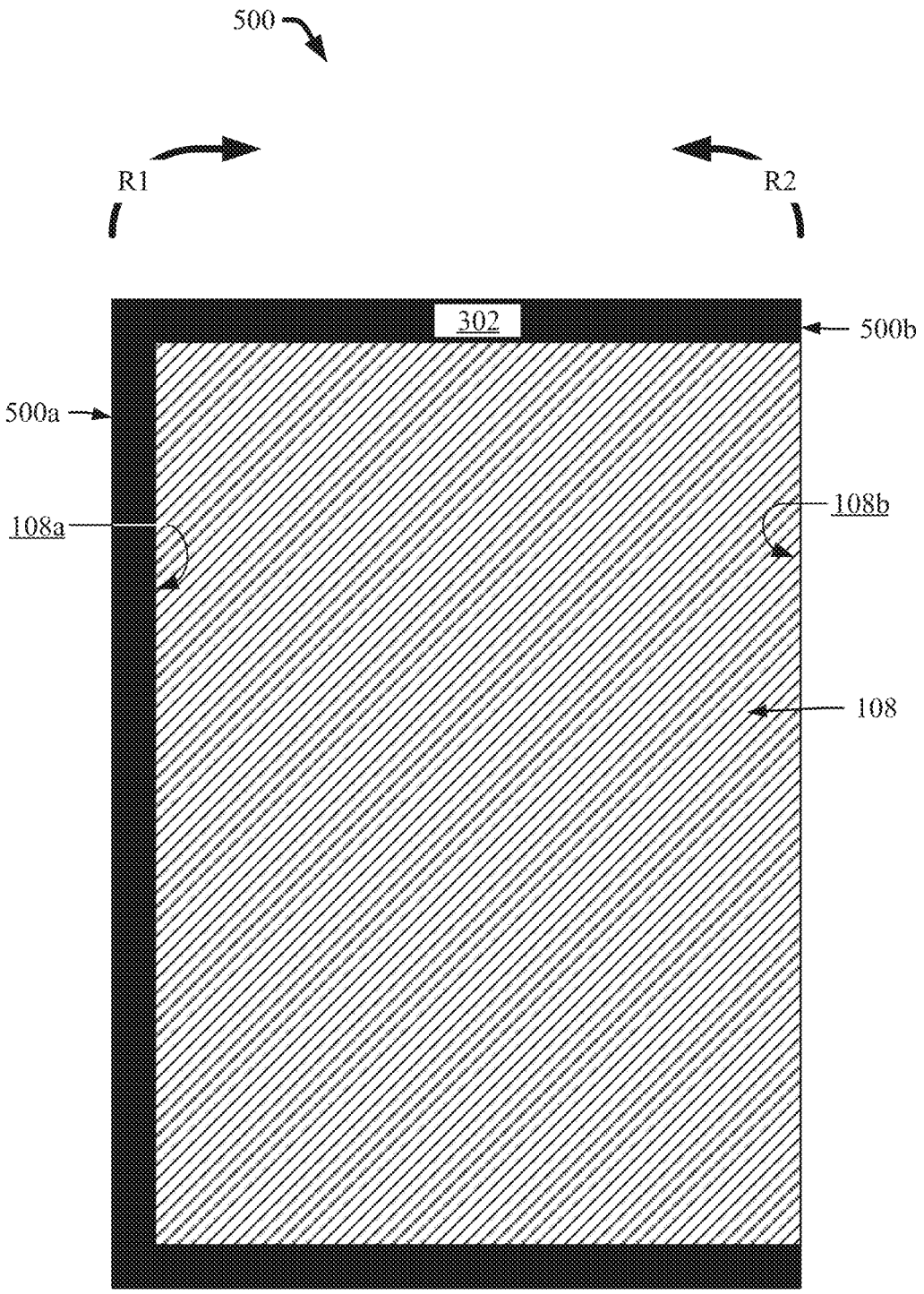
FIG. 5 illustrates a diagram of an example non-limiting sheet of carrier layer, adhesive layer, and SMS liner layer that can be employed to manufacture one or more vacuum bags in accordance with one or more embodiments described herein.

For example, the longitudinal seam 204 exemplified in FIG. 4 can be formed from a sheet 500 of carrier layer 106 having one or more adhesive layers 302 and SMS liner layers 108 in accordance with the positioning shown in FIG. 5. As shown in FIG. 5, the one or more carrier layers 106 can be covered by the one or more adhesive layers 302. Further, the one or more SMS liner layers 108 can be adhered to the one or more carrier layers 106 (e.g., via the one or more adhesive layers 302).

In one or more embodiments, the one or more SMS liner layers 108 can be absent from one or more margins (e.g., having a width ranging from, for example, 0.25 inches to 12 inches) of the sheet 500. For instance, the exemplary sheet 500 shown in FIG. 5 includes one or more SMS liner layers 108 absent from at least a side margin (e.g., left margin) adjacent to a first end 500*a* (e.g., left end) of the sheet 500. During manufacturing of the vacuum bag 100, the first end 500*a* of the sheet 500 can be bent and/or folded along the first rotation direction "R1". Likewise, the second end 500*b* (e.g., right end) of the sheet 500 can be bent and/or folded along the second rotation direction "R2". Thereby, the first and second ends 500*a*, 500*b* (left and/or right ends) of the sheet 500 can be bent and/or folded towards each other until the first edge 108*a* (e.g., left edge) of the SMS liner layer 108 and the second edge 108*b* (e.g., right edge) of the SMS liner layer 108 meet each other, whereupon the portion of carrier layer 106 comprising the left margin can overlap the second end 500*b* (e.g., right end) of the sheet 500. Further, the overlapped portion of carrier layer 106 can be pressed onto the underlying portion of carrier layer 106 to facilitate adhesion between the two portions (e.g., via the one or more adhesive layers 302) and establish the structure shown in FIG. 4.

Figure 6:
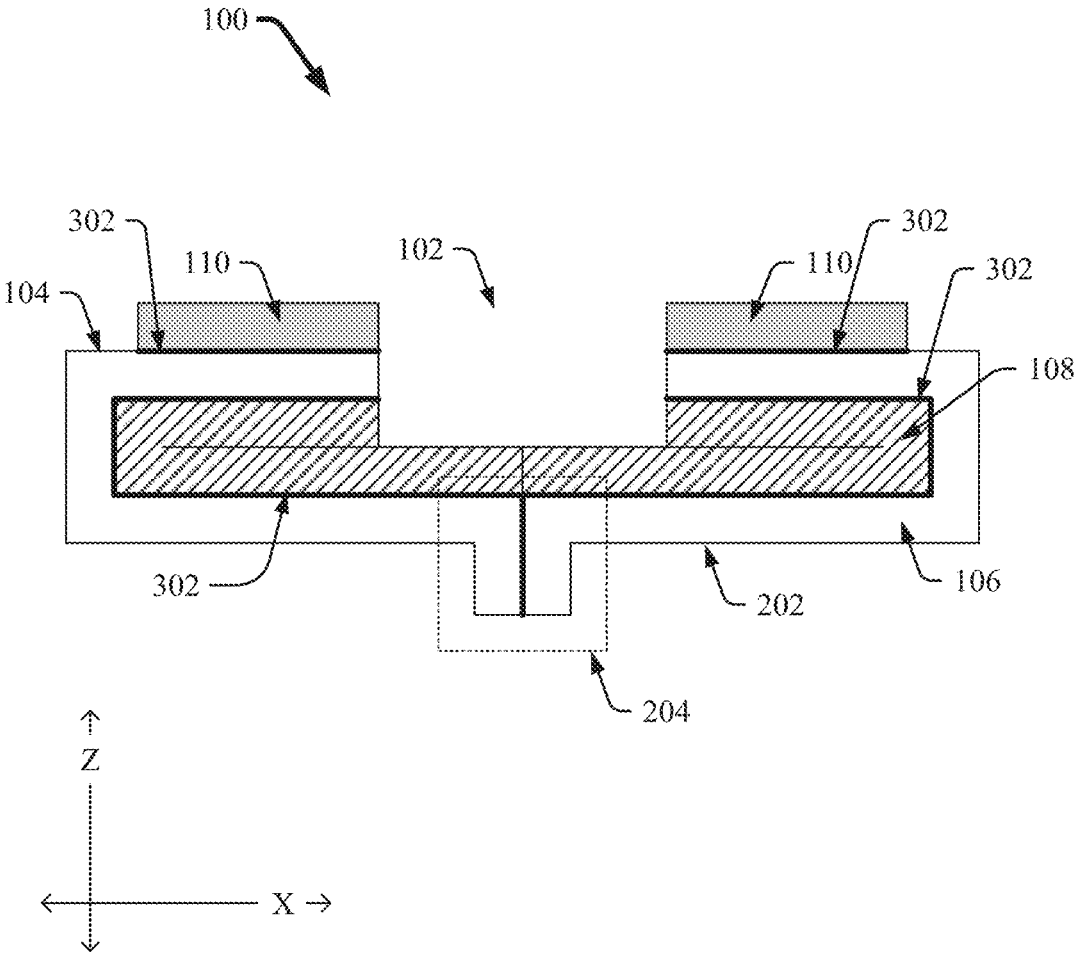
FIG. 6 illustrates a diagram of an example, non-limiting cross-section of a longitudinal seam of one or more vacuum bags with one or more SMS liners in accordance with one or more embodiments described herein.

FIG. 6 illustrates another diagram of an example, non-limiting cross-sectional view of the vacuum bag 100 along a plane that includes the one or more inlets 102 in accordance with one or more embodiments described herein. Repetitive description of like elements employed in other embodiments described herein is omitted for the sake of brevity. For example, FIG. 6 depicts another example structure that can be embodied by the one or more longitudinal seams 204. In one or more embodiments, portions of the one or more carrier layers 106 can be bent and pressed together to form the longitudinal seam 204 structure shown in FIG. 6.

Figure 7:
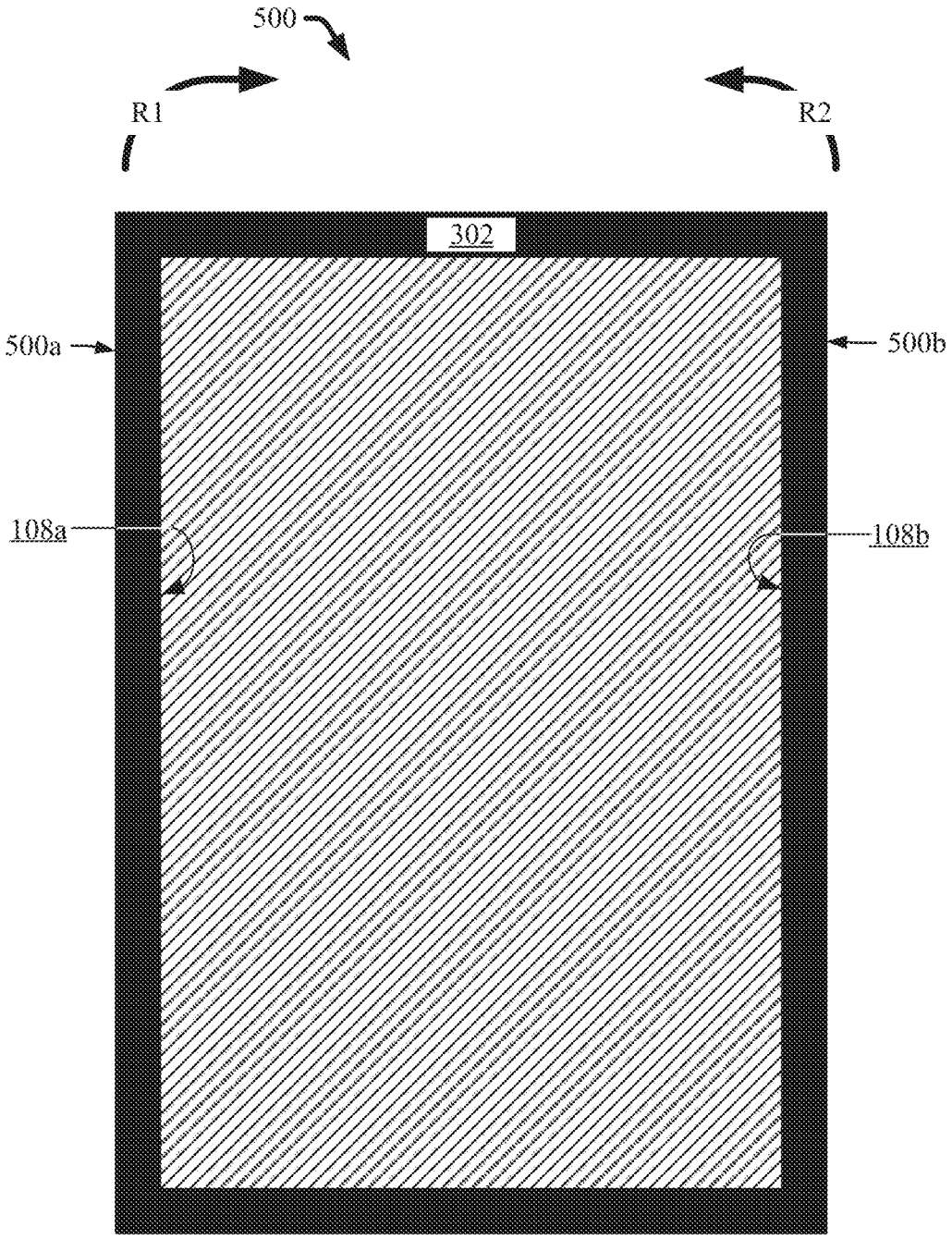
FIG. 7 illustrates a diagram of an example non-limiting sheet of carrier layer, adhesive layer, and SMS liner layer that can be employed to manufacture one or more vacuum bags in accordance with one or more embodiments described herein.

As described herein, the vacuum bag 100 can be manufacturing from a sheet 500 of the one or more carrier layers 106 with the one or more SMS liner layers 108 adhered thereto. As shown in FIG. 7, in one or more embodiments, the one or more SMS liner layers 108 can further be absent from a right margin adjacent to the second end 500*b* (e.g., right end) of the sheet 500. The first and/or second ends 500*a*, 500*b* (e.g., left and/or right ends) of the sheet 500 can be bent and/or folded towards each other along the first rotation direction R1 and the second rotation direction R2. Further, portions of the carrier layer 106 comprising the side margins (e.g., left and right margins) can be bent to enable the first edge 108*a* (e.g., left edge) and the second edge 108*b* (e.g., right edge) of the one or more SMS liner layers 108 to meet. Once the first edge 108*a* (e.g., left edge) and the second edge 108*b* (e.g., right edge) of the one or more SMS liner layers 108 meet, the left and right margins of the sheet 500 can be pressed together to facilitate an adhesion (e.g., via the one or more adhesive layers 302) that can establish the longitudinal seam 204 structure shown in FIG. 6.

Figure 8:
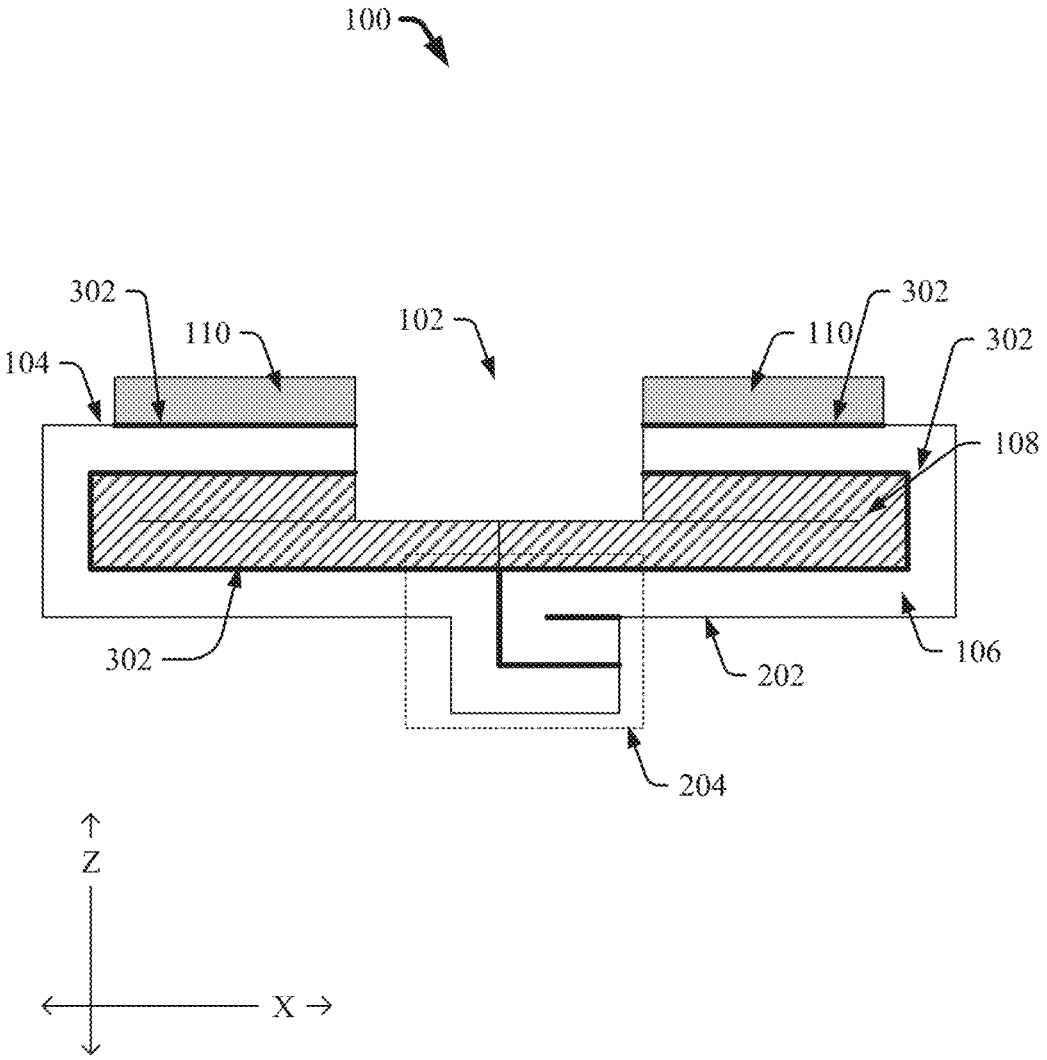
FIG. 8 illustrates a diagram of an example, non-limiting cross-section of a longitudinal seam of one or more vacuum bags with one or more SMS liners in accordance with one or more embodiments described herein.

FIG. 8 illustrates another diagram of an example, non-limiting cross-sectional view of the vacuum bag 100 along a plane that includes the one or more inlets 102 in accordance with one or more embodiments described herein. Repetitive description of like elements employed in other embodiments described herein is omitted for the sake of brevity. For example, FIG. 8 depicts a third example structure that can be embodied by the one or more longitudinal seams 204. In the third example longitudinal seam 204 structure, the bent portions of carrier layer 106 shown in FIG. 6 can be further folded onto the surface of the surrounding carrier layer 106 (e.g., folded onto the back side 202 of the vacuum bag 100). As shown in FIG. 8, the one or more adhesive layers 302 can be further positioned on one or more sides of the bent portions of carrier layer 106 such that folding the bent portions can further adhere the bent portions to the surround surface of carrier layer 106.

Figure 9:
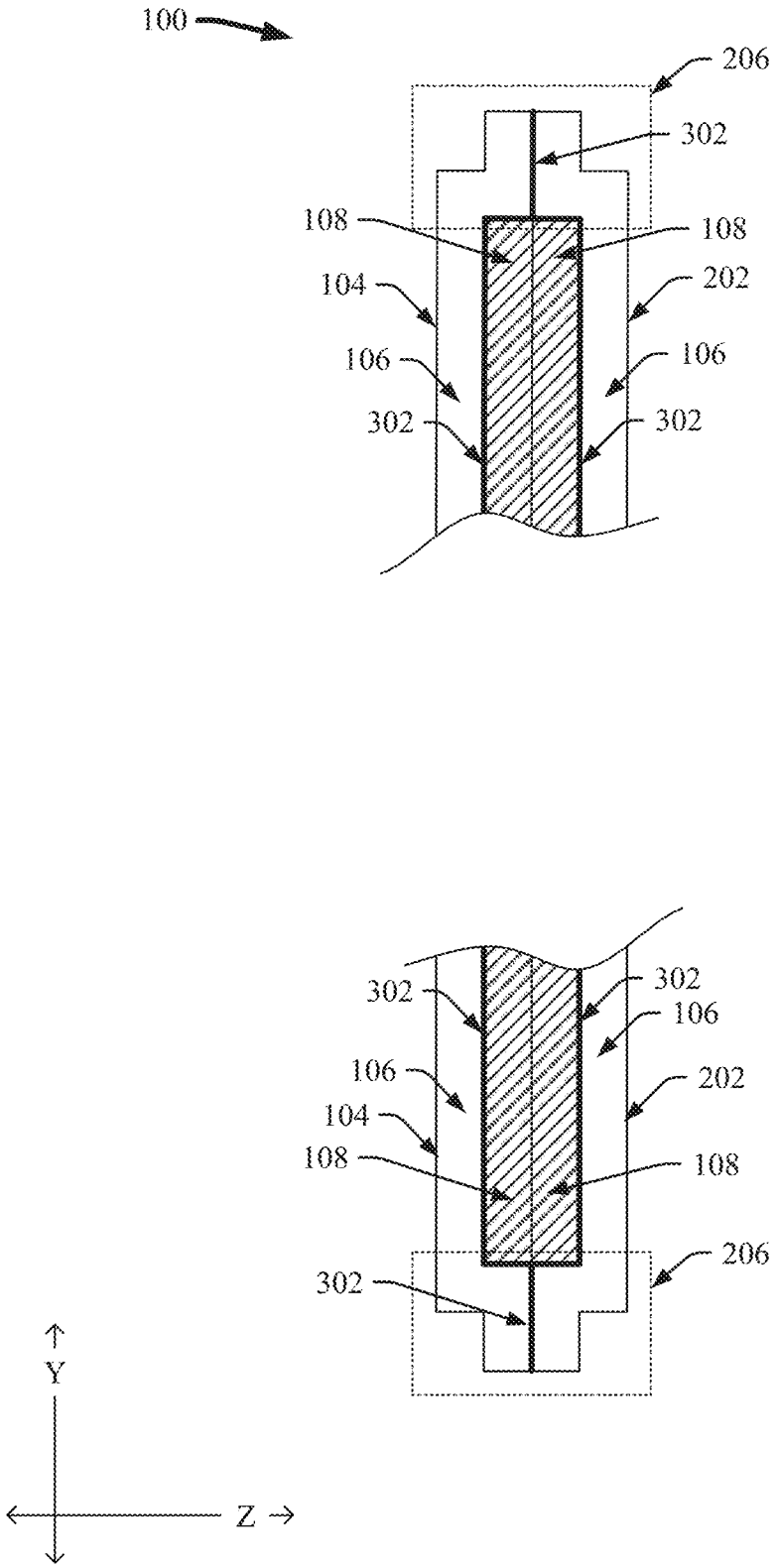
FIG. 9 illustrates a diagram of an example, non-limiting cross-section of one or more lateral seams of one or more vacuum bags with one or more SMS liners in accordance with one or more embodiments described herein.

FIG. 9 illustrates a diagram of an example, non-limiting cross-sectional view of the vacuum bag 100 comprising a one or more lateral seams 206 in accordance with one or more embodiments described herein. Repetitive description of like elements employed in other embodiments described herein is omitted for the sake of brevity. In one or more embodiments, the vacuum bag 100 can comprise a plurality of lateral seams 206 (e.g., a top lateral seam 206 and/or a bottom lateral seam 206). As shown in FIG. 9, the one or more lateral seams 206 can comprise respective portions of the one or more carrier layers 106 adhered together via the one or more adhesive layers 302.

As described herein, the vacuum bag 100 can be formed from a sheet 500 of one or more carrier layers 106, adhesive layers 302, and/or SMS liner layers 108. As shown in FIGS. 5 and/or 7, the sheet 500 can include a top margin and a bottom margin, which can lack SMS liner layers 108. As the first end 500*a* (e.g., left end) of the sheet is bent/folded in the first rotation direction R1 and the second end 500*b* (e.g., right end) of the sheet is bent/folded in the second rotation direction R2, the top and/or bottom margins of the sheet 500 can be folded onto themselves. As shown in FIG. 9, overlapping the top margin upon itself can form a top lateral seam 206, and overlapping the bottom margin upon itself can form a bottom lateral seam 206. Thereby, a lateral seam 206 structure can be formed in which a portion of the carrier layer 106 constituting the front side 104 of the vacuum bag 100 can be directly adhered to (e.g., via the one or more adhesive layers 302) another portion of the carrier layer 106 constituting the back side 202 of the vacuum bag 100. At least because the one or more SMS liner layers 108 can be absent from the top and/or bottom margins of the sheet 500, the one or more lateral seams 206 can comprise a direct adhesion of respective portions of the one or more carrier layers 106, which can be facilitated by the one or more adhesive layers 302 without the need for welding techniques (e.g., sonic welding).

Figure 10:
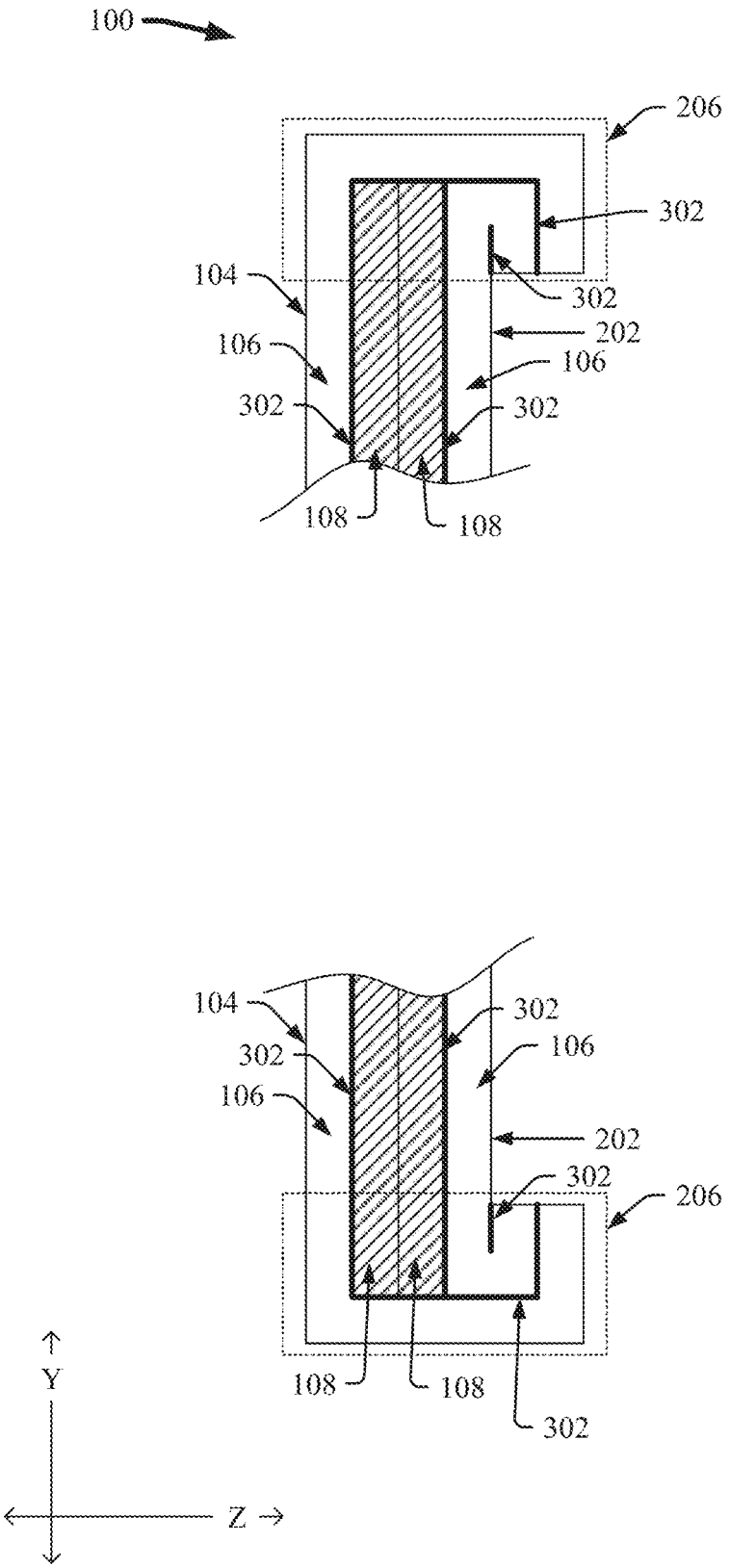
FIG. 10 illustrates a diagram of an example, non-limiting cross-section of one or more lateral seams of one or more vacuum bags with one or more SMS liners in accordance with one or more embodiments described herein.

FIG. 10 illustrates a diagram of an example, non-limiting cross-sectional view of the vacuum bag 100 comprising a one or more lateral seams 206 with an additional example structure in accordance with one or more embodiments described herein. Repetitive description of like elements employed in other embodiments described herein is omitted for the sake of brevity. In various embodiments, the lateral seam 206 structure depicted in FIG. 9 can be further modified to achieve the example lateral seam 206 structure shown in FIG. 10. For example, the adhered portions of the one or more carrier layers 106 can be folded onto a side (e.g., back side 202) of the vacuum bag 100. Further, one or more adhesive layers 302 can be applied to the surface of the adhered portions of the one or more carrier layers 106 such that folding the adhered portions onto the side (e.g., back side 202) of the vacuum bag 100 can further adhere the portions to the side (e.g., back side 202) of the vacuum bag 100. For instance, the lateral seam 206 structure shown in FIG. 9 can be formed, one or more adhesive layers 302 can be applied to the back side 202 of the vacuum bag 100 adjacent to the overlapped top and/or bottom margins, and/or the overlapped top and/or bottom margins can be folded onto the back side 202 of the vacuum bag 100 to form the one or more lateral seam 206 structures shown in FIG. 10.

FIG. 11 illustrates a flow diagram of an example, non-limiting method 1100 that can facilitate manufacturing one or more longitudinal seams 204 of the vacuum bags 100 in accordance with one or more embodiments described herein. Repetitive description of like elements employed in other embodiments described herein is omitted for the sake of brevity.

At 1102, the method 1100 can comprise providing one or more sheets of carrier layer 106 (e.g., comprising paper). In one or more embodiments, the one or more sheets can be provided with predefined dimensions. In some embodiments, the one or more sheets can be provided from one or more rolls of the carrier layer 106 and cut at defined intervals through the manufacturing of the vacuum bags 100.

At 1104, the method 1100 can comprise depositing one or more adhesive layers 302 onto the carrier layer 106. For example, the one or more adhesive layers 302 can be provided onto a surface of the sheet of carrier layer 106 that will define an interior circumference of the vacuum bag 100. In various embodiments, the one or more adhesive layers 302 can be deposited continuous across the sheet of carrier layer 106. In some embodiments, the one or more adhesive layers 302 can be deposited in accordance with one or more patterns onto the sheet of carrier layer 106. For instance, the one or more adhesive layers 302 can be deposited in a series of rows and/or columns across the sheet of carrier layer 106. Additionally, in one or more embodiments, the one or more adhesive layers 302 can be deposited onto the sheet of carrier layer 106 up to the edges of the sheet.

At 1106, the method 1100 can comprise depositing one or more SMS liner layers 108 onto the one or more adhesive layers 302 and absent a top, bottom, and/or side margin of the sheet of carrier layer 106. For example, the one or more SMS liner layers 108 can be deposited onto the one or more adhesive layers 302 in accordance with FIGS. 5 and/or 7. In various embodiments, the depositing the one or more SMS liner layers 108 can form the sheet 500 exemplified in FIGS. 5 and/or 7. For instance, the top, bottom, and/or side margin of the sheet 500 can comprise carrier layer 106 and adhesive layer 302 absent SMS liner layer 108. In one or more embodiments, the one or more SMS liner layers 108 can further be absent from both side margins of the sheet 500, as shown in FIG. 7. In various embodiments, the one or more SMS liner layers 108 can be fed from one or more rolls of SMS material, where the SMS material feed can be cut at defined lengths to facilitate the depositing at 1106.

At 1108, the method 1100 can comprise forcing a first side 500*a* and/or a second end 500*b* of the sheet 500 towards a center of the sheet 500 until a first edge 108*a* of the one or more SMS liner layers 108 meets a second edge 108*b* of the one or more SMS liner layers 108. For example, the first end 500*a* and/or second end 500*b* of the sheet 500 can be bent and/or folded along rotation direction R1 and/or R2 to facilitate the forcing at 1108. In various embodiments, the forcing at 1108 can form the sheet 500 manufactured at 1102-1106 into a tube shape. For instance, the sheet 500 can be wrapped around a mold to facilitate the forcing at 1108.

At 1110, the method 1100 can comprise overlapping the side margin of the sheet 500 onto the one or more carrier layers 106 located at the second end 500*b* of the sheet 500. For example, the sheet 500 can have a structure exemplified in FIG. 5, where the left side margin located at the first side 500*a* of the sheet 500 can overlap the second end 500*b* of the sheet 500 as a result of the forcing at 1108. At 1112, the method 1100 can comprise pressing the side margin of the sheet 500 and the underlying carrier layer 106 together to form one or more longitudinal seams 204. For example, the portion of adhesive layer 302 located in the side margin of the sheet 500 can be positioned between the overlapping carrier layer 106 portion and underlying carrier layer 106 portion as a result of the forcing at 1108 and the overlapping at 1110. Thus, the pressing at 1112 can force the overlapping portion of carrier layer 106 and underlying portion of carrier layer 106 into direct contact with the adhesive layer 302; thereby, adhering the carrier layer 106 portions together. For example, the forcing at 1108, overlapping at 1110, and pressing at 1112 can achieve the longitudinal seam 204 structure exemplified in FIG. 5. In various embodiments, manufacturing of the vacuum bag 100 can proceed with method 1200 to form the one or more inlets 102.

Figure 12:
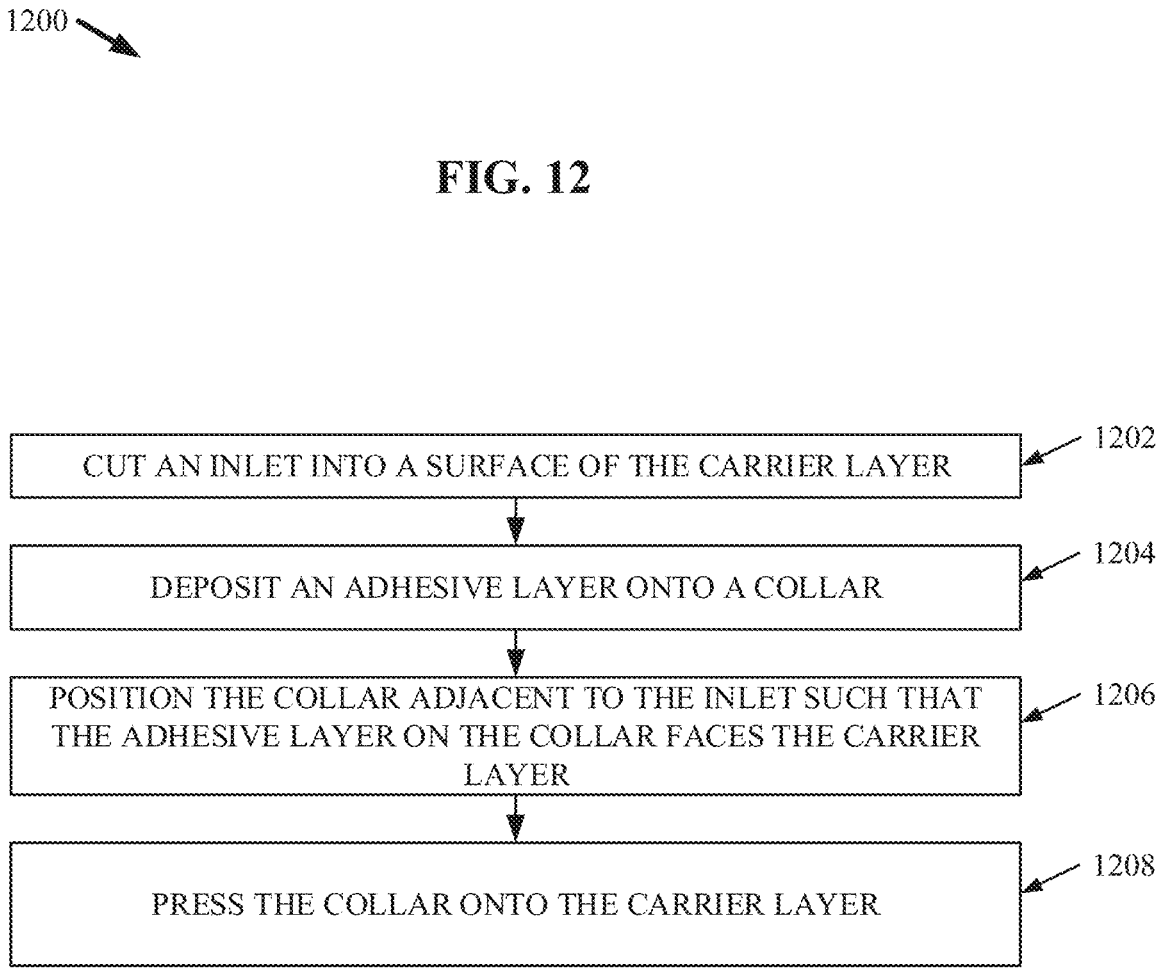
FIG. 12 illustrates a flow diagram of an example, non-limiting method that can facilitate forming one or more inlets of a vacuum bag in accordance with one or more embodiments described herein.

FIG. 12 illustrates a flow diagram of an example, non-limiting method 1200 that can facilitate manufacturing one or more inlets 102 of the vacuum bags 100 in accordance with one or more embodiments described herein. Repetitive description of like elements employed in other embodiments described herein is omitted for the sake of brevity. In various embodiments, method 1200 can be performed prior to formation of the longitudinal seam 204 in method 1100 (e.g., prior to steps 1108-1112), concurrently with one or more steps of method 1100 (e.g., concurrently with steps 1108-1112), or subsequent to method 1100.

At 1202, the method 1200 can comprise cutting one or more inlets 102 into a surface of the one or more carrier layers 106. For example, the cutting at 1202 can extend through a carrier layer 106, an adhesive layer 302, and a SMS liner layer 108. In various embodiments, a die and punch can be employed to cut the one or more inlets 102 at 1202. In one or more embodiments, forming the longitudinal seam 204 via method 1100 can form a front side 104 and back side 202 of the vacuum bag 100. For example, the surface of the carrier layer 106 comprising the one or more longitudinal seams 204 can be the back side 202 of the vacuum bag 100 and the opposite surface of the carrier layer 106 can be the front side 104 of the vacuum bag 100. In one or more embodiments, the cutting at 1202 can be performed into the front side 104 of the vacuum bag 100.

At 1204, the method 1200 can comprise depositing one or more adhesive layers 302 onto one or more collars 110. As shown in FIGS. 1, 4, 6, and/or 8, the one or more collars 110 can have a hole complementary to the one or more inlets 102. The one or more adhesive layers 302 can be deposited onto the one or more collars 110 adjacent to the complementary hole. At 1206, the method 1200 can comprise positioning the one or more collars 110 adjacent to the one or more inlets 102 such that the one or more adhesive layers 302 on the one or more collars 110 face the carrier layer 106. In various embodiments, the one or more collars 110 can be fed from a stack of collars 110 and positioned adjacent to the one or more inlets 102 via a conveyor system. At 1208, the method 1200 can comprise pressing the one or more collars 110 onto the carrier layer 106. For example, the pressing at 1208 can adhere the one or more collars 110 to the carrier layer 106 via the one or more adhesive layers 302 such that the one or more collars 110 at least partially surround the one or more inlets 102.

Figure 13:
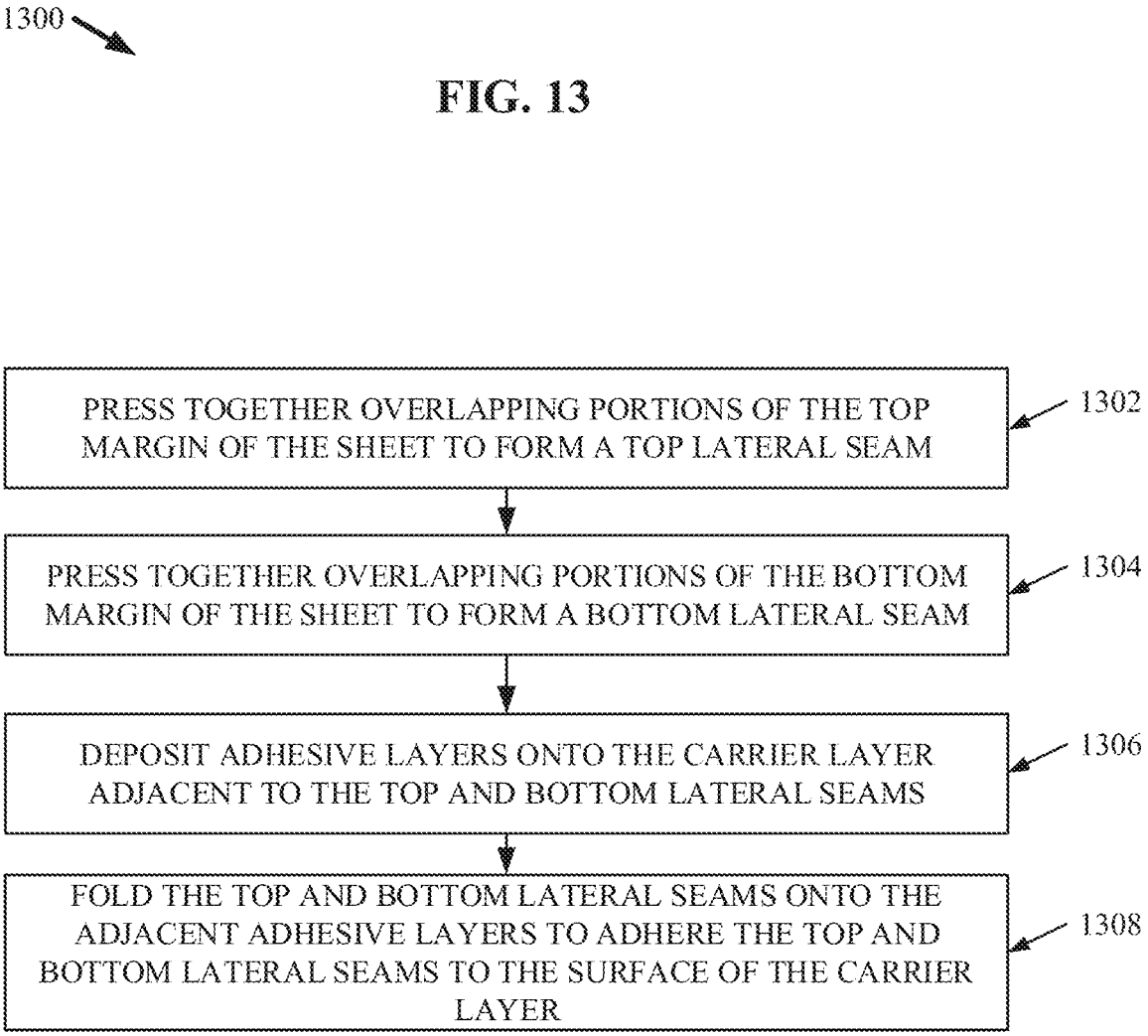
FIG. 13 illustrates a flow diagram of an example, non-limiting method that can facilitate forming one or more lateral seams of a vacuum bag in accordance with one or more embodiments described herein.

FIG. 13 illustrates a flow diagram of an example, non-limiting method 1300 that can facilitate manufacturing one or more lateral seams 206 of the vacuum bags 100 in accordance with one or more embodiments described herein. Repetitive description of like elements employed in other embodiments described herein is omitted for the sake of brevity. In various embodiments, method 1200 can be performed subsequent to and/or concurrently with method 1100. Also, method 1300 can be performed prior to, subsequent to, or concurrently with method 1200.

At 1302, the method 1300 can comprise pressing together overlapping portions of the top margin of the sheet 500 to form a top lateral seam 206. For example, the forcing at 1108 can cause the top margin of the sheet 500 to overlap itself. For instance, forcing the sides of the sheet 500 in the first rotation direction R1 and/or second rotation direction R2 can result in the top margin overlapping itself across the width of the vacuum bag 100. At 1304, the method 1300 can comprise pressing together overlapping portions of the bottom margin of the sheet 500 to form a bottom lateral seam 206. For example, the forcing at 1108 can cause the bottom margin of the sheet 500 to overlap itself. For instance, forcing the sides of the sheet 500 in the first rotation direction R1 and/or second rotation direction R2 can result in the bottom margin overlapping itself across the width of the vacuum bag 100. In various embodiments, the pressing at 1302 and 1304 can be performed concurrently, simultaneously, or subsequently. In one or more embodiments, the pressing at 1302 and 1304 can result in the lateral seam 206 structure exemplified in FIG. 9.

At 1306, the method 1300 can comprise depositing one or more adhesive layers 302 onto the carrier layer 106 adjacent to the top and bottom lateral seams 206 formed at 1302 and 1304. For example, the one or more adhesive layers 302 can be deposited on portions of the back side 202 of the vacuum bag 100 adject to the lateral seams 206. At 1308, the method 1300 can comprise folding the top and/or bottom lateral seams 206 onto the adjacent adhesive layers 302 (e.g., deposited at 1306) to adhere the top and/or bottom lateral seams 206 to the surface of the carrier layer 106 (e.g., back side 202 of the vacuum bag 100). In various embodiments, the folding at 1308 can result in the lateral seam 206 structure exemplified in FIG. 10.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

It is, of course, not possible to describe every conceivable combination of components, products and/or methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim. The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A vacuum bag, comprising:

a spunbond meltblown spunbond (SMS) liner layer adhered to a carrier layer of non-woven material, wherein the SMS liner layer comprises a meltblown polymer dispersed between spunbond polymer fibers in a single layer of spunbond polymer; and a seam comprising an adhesive layer bonding a first end of the carrier layer directly to a second end of the carrier layer.

2. The vacuum bag of claim 1, wherein the first end of the carrier layer comprises a portion that is absent the SMS liner layer, wherein the portion overlaps onto a first surface of the second end of the carrier layer, and wherein the SMS liner layer is located at a second surface of the second end of the carrier layer.

3. The vacuum bag of claim 2, wherein the first surface of the second end of the carrier layer is opposite the second surface of the second end of the carrier layer.

4. The vacuum bag of claim 1, wherein the non-woven material is paper.

5. The vacuum bag of claim 1, further comprising:

an inlet that extends through a portion of the carrier layer and a portion of the SMS liner layer, wherein the SMS liner layer is positioned within an interior of the vacuum bag that is in fluid communication with the inlet.

6. The vacuum bag of claim 1, wherein the SMS liner layer is adhered to the carrier layer via an adhesive, and wherein the adhesive is a portion of the adhesive layer.

7. The vacuum bag of claim 6, wherein the adhesive layer comprises at least one of a hotmelt adhesive, a cold glue adhesive, a dry-bond adhesive, or a thermoplastic polymer adhesive.

8. A vacuum bag, comprising:

a spunbond meltblown spunbond (SMS) liner layer adhered to a paper layer, wherein the SMS liner layer comprises a meltblown polymer dispersed between spunbond polymer fibers in a single layer of spunbond polymer; and one or more seams comprising a first end of the paper layer directly bonded to a second end of the paper layer via an adhesive layer.

9. The vacuum bag of claim 8, wherein the first end of the paper layer comprises a portion that is absent the SMS liner layer, wherein the portion overlaps onto a first surface of the second end of the paper layer, and wherein the SMS liner layer is located at a second surface of the second end of the paper layer.

10. The vacuum bag of claim 9, wherein the first surface of the second end of the paper layer is opposite the second surface of the second end of the paper layer.

11. The vacuum bag of claim 8, wherein the SMS liner layer has a weight ranging from about 20 grams per square meter ($g/m^2$) to about 40 $g/m^2$.

12. The vacuum bag of claim 8, wherein the SMS liner layer is adhered to the paper layer via an adhesive.

13. The vacuum bag of claim 12, wherein the adhesive is a portion of the adhesive layer.

14. The vacuum bag of claim 8, wherein the adhesive layer comprises at least one of a hotmelt adhesive, a cold glue adhesive, a dry-bond adhesive, or a thermoplastic polymer adhesive.

15. A method for manufacturing a vacuum bag, comprising:

adhering a spunbond meltblown spunbond (SMS) liner layer to a carrier layer of non-woven material, wherein the SMS liner layer comprises a meltblown polymer dispersed between spunbond polymer fibers in a single layer of spunbond polymer; and bonding a first end of the carrier layer directly to a second end of the carrier layer using an adhesive layer to form a seam.

16. The method for manufacturing the vacuum bag of claim 15, wherein the first end of the carrier layer comprises a portion that is absent the SMS liner layer, wherein the portion overlaps onto a first surface of the second end of the carrier layer, and wherein the SMS liner layer is located at a second surface of the second end of the carrier layer.

17. The method for manufacturing the vacuum bag of claim 16, wherein the first surface of the second end of the carrier layer is opposite the second surface of the second end of the carrier layer.

18. The method for manufacturing the vacuum bag of claim 15, wherein the non-woven material is paper.

19. The method for manufacturing the vacuum bag of claim 15, further comprising:

forming an inlet that extends through a portion of the carrier layer and a portion of the SMS liner layer, wherein the SMS liner layer is positioned within an interior of the vacuum bag that is in fluid communication with the inlet.

20. The method for manufacturing the vacuum bag of claim 15, wherein the SMS liner layer is adhered to the carrier layer via an adhesive, and wherein the adhesive is a portion of the adhesive layer.

* * * * *